US011206904B2

(12) United States Patent
Ma

(10) Patent No.: US 11,206,904 B2
(45) Date of Patent: Dec. 28, 2021

(54) QUICK ASSEMBLY METHODS AND COMPONENTS FOR SHADE STRUCTURES

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 16/857,658

(22) Filed: Apr. 24, 2020

(65) Prior Publication Data

US 2020/0315306 A1 Oct. 8, 2020

Related U.S. Application Data

(63) Continuation of application No. 15/759,773, filed as application No. PCT/US2016/051771 on Sep. 14, 2016, now Pat. No. 10,631,603.

(60) Provisional application No. 62/218,400, filed on Sep. 14, 2015.

(51) Int. Cl.

| | |
|---|---|
| ***A45B 25/02*** | (2006.01) |
| ***A45B 25/06*** | (2006.01) |
| ***A45B 25/10*** | (2006.01) |

(52) U.S. Cl.

CPC ..... *A45B 25/06* (2013.01); *A45B 25/02* (2013.01); *A45B 25/10* (2013.01)

(58) Field of Classification Search

CPC ..... A45B 25/02
USPC ..... 135/29
See application file for complete search history.

(56) References Cited

U.S. PATENT DOCUMENTS

| | | | |
|---|---|---|---|
| 331,231 | A | 11/1885 | Folger |
| 476,364 | A | 6/1892 | Collins |
| 501,089 | A | 7/1893 | Lichtenstein |
| 620,815 | A | 3/1899 | Warren |
| 750,178 | A | 1/1904 | Fesenfeld |
| 770,704 | A | 9/1904 | Vogel |
| 847,805 | A | 3/1907 | McAvoy |
| 899,718 | A | 9/1907 | Eberle |
| 878,270 | A | 2/1908 | Blake et al. |
| 880,534 | A | 3/1908 | Hoyt |
| 897,026 | A | 8/1908 | Seitzinger |
| 924,627 | A | 6/1909 | Baker et al. |
| 928,169 | A | 7/1909 | Bardon |

(Continued)

FOREIGN PATENT DOCUMENTS

| | | |
|---|---|---|
| CA | 1269018 | 5/1990 |
| CN | 2722687 | 9/2005 |

(Continued)

OTHER PUBLICATIONS

EPO Extended Search Report dated Apr. 5, 2011 for European Patent No. 09252140.0, filed Sep. 7, 2009.

(Continued)

*Primary Examiner* — Noah Chandler Hawk
(74) *Attorney, Agent, or Firm* — Knobbe, Martens, Olson & Bear, LLP

(57) ABSTRACT

A quick connect system is provided for a shade structure. The system includes a hub and a rib. The hub has an upper portion, a lower portion, and a rib engagement section. The rib engagement section includes a groove. The groove includes an annular bearing zone, which may be disposed between two facing walls of the hub. The rib includes an elongate body having an inner end and an outer end, the inner end of the rib including a pivot member. The annular bearing zone is configured to support end portion of the pivot member of the rib.

19 Claims, 12 Drawing Sheets

(56) References Cited

U.S. PATENT DOCUMENTS 941,952 A 11/1909 Riehl
947,790 A 2/1910 Carter
959,127 A 5/1910 Edwards
1,001,076 A 8/1911 Redford
1,022,944 A 4/1912 Hodinger
1,078,069 A 11/1913 Simons
1,107,415 A 8/1914 Drohan
1,264,075 A 4/1918 Hout
1,469,495 A 10/1923 Bunker
1,712,430 A 5/1929 Giszczynski
1,808,610 A 6/1931 Roy
1,852,513 A 4/1932 Frey
1,862,674 A 6/1932 Frey
2,101,510 A 12/1937 Rathbun
2,207,043 A 7/1940 Weiss et al.
2,321,495 A 6/1943 Levin
2,336,116 A 12/1943 Morando
2,385,575 A 9/1945 Isler
2,469,637 A 5/1949 Evans et al.
2,635,616 A 4/1953 Haydu
2,762,383 A 9/1956 Wittman
2,796,073 A 6/1957 Wittman
2,860,647 A 11/1958 Negri
2,914,154 A 11/1959 Russell
3,157,186 A 11/1964 Hammer
3,177,882 A 4/1965 Vincent
3,181,542 A 5/1965 Bareis
3,252,468 A 5/1966 Militano
3,330,582 A 7/1967 Morris
3,424,180 A 1/1969 Andolfi
3,462,179 A 8/1969 Hinkle
3,557,809 A 1/1971 Vazquez et al.
3,643,673 A 2/1972 Weber
3,704,479 A 12/1972 Whitaker
D231,955 S 6/1974 Weber
4,201,237 A 5/1980 Watts et al.
4,368,749 A * 1/1983 Lindler ..... A45B 25/02 135/15.1
4,369,000 A 1/1983 Egnew
4,627,210 A 12/1986 Beaulieu
4,673,308 A 6/1987 Reilly
4,750,509 A 6/1988 Kim
4,790,338 A 12/1988 Strobl
4,941,499 A 7/1990 Pelsue et al.
4,966,178 A 10/1990 Eichhorn
D320,111 S 9/1991 Ma
5,056,291 A 10/1991 Leung
D321,779 S 11/1991 Ma
5,069,572 A 12/1991 Niksic
5,085,239 A 2/1992 Chin-Hung et al.
5,188,137 A 2/1993 Simonelli
5,193,566 A 3/1993 Chen
5,328,286 A 7/1994 Lee
D360,522 S 7/1995 Ko
5,433,233 A 7/1995 Shiran et al.
5,445,471 A 8/1995 Wexler et al.
5,694,958 A 12/1997 Chang
5,715,853 A * 2/1998 Lin ..... A45B 25/02 135/29
5,738,129 A 4/1998 Vogt
5,740,824 A 4/1998 Tang
5,746,235 A * 5/1998 Lin ..... A45B 25/02 135/29
5,797,613 A 8/1998 Busby
5,797,695 A 8/1998 Prusmack
5,842,494 A 12/1998 Wu
D411,655 S 6/1999 Tung
5,911,233 A 6/1999 Wu
D412,056 S 7/1999 Wang
6,076,540 A 6/2000 You
6,095,169 A 8/2000 Lin et al.
6,116,256 A 9/2000 Pawsey et al.
6,199,572 B1 3/2001 Rousselle et al.
6,227,753 B1 5/2001 Boer
6,298,867 B1 10/2001 Chang
6,311,706 B1 11/2001 Sato
6,314,976 B1 * 11/2001 Clarke ..... A45B 23/00 135/28
6,332,657 B1 12/2001 Fischer
6,345,637 B1 2/2002 Ko
6,354,316 B1 3/2002 Chen
6,374,840 B1 4/2002 Ma
6,386,215 B1 5/2002 Chang
6,397,867 B2 6/2002 You
D460,947 S 7/2002 Montena
D465,915 S 11/2002 Earnshaw
6,499,856 B2 12/2002 Lee
6,604,844 B2 8/2003 Hussey
6,643,889 B1 11/2003 Kotlarski
6,651,682 B1 11/2003 Woodward
6,701,946 B2 3/2004 You
6,705,335 B2 3/2004 You
6,732,753 B2 5/2004 Chang
6,758,228 B1 7/2004 You
6,758,354 B2 7/2004 Carletti
6,769,441 B2 8/2004 Liu
6,814,093 B2 11/2004 You
6,904,923 B2 6/2005 Chai et al.
7,178,535 B2 2/2007 Eder
7,464,503 B2 12/2008 Hoberman
7,481,235 B2 1/2009 Prusmack
7,509,967 B2 3/2009 Kim
7,574,777 B1 8/2009 Fuller et al.
7,637,276 B2 12/2009 Mallookis et al.
7,686,024 B1 3/2010 Lai
7,703,464 B2 4/2010 Ma
D623,396 S 9/2010 He
D626,324 S 11/2010 Ma
7,861,734 B2 1/2011 Ma
D631,848 S 2/2011 Montena et al.
7,891,367 B2 2/2011 Ma
8,061,375 B2 11/2011 Ma
8,069,872 B2 12/2011 Bae
8,082,935 B2 12/2011 Ma
8,082,937 B2 12/2011 Tarter et al.
8,166,986 B2 5/2012 Ma
D661,659 S 6/2012 Natoli et al.
D662,064 S 6/2012 Natoli et al.
D668,446 S 10/2012 Patzak
D670,901 S 11/2012 Rothbucher et al.
8,356,613 B2 1/2013 Ma
8,360,085 B2 1/2013 Lee
8,485,208 B2 7/2013 Seo
8,496,019 B2 7/2013 Zhou
8,522,804 B1 9/2013 Tung
8,534,304 B1 9/2013 Tung
8,555,905 B2 10/2013 Ma
8,763,620 B1 7/2014 Tung
8,800,577 B2 8/2014 Ma et al.
D719,342 S 12/2014 Ma
D719,343 S 12/2014 Ma
8,899,250 B1 12/2014 Tung
9,060,576 B2 6/2015 Siegenthaler
9,078,497 B2 7/2015 Ma
9,113,683 B2 8/2015 Ma
D738,609 S 9/2015 Ma
9,192,215 B2 11/2015 Ma
D744,742 S 12/2015 You
D749,835 S 2/2016 Whitaker
9,265,313 B1 2/2016 Ma
D750,364 S 3/2016 Lah
9,433,269 B2 9/2016 Ma
9,498,030 B2 11/2016 Ma
9,615,637 B1 4/2017 Tung
D786,661 S 5/2017 Wright
D813,525 S 3/2018 Ma
D814,173 S 4/2018 Ma
10,034,524 B2 7/2018 Ma
D826,543 S 8/2018 Ma
10,060,152 B2 8/2018 Ma
D833,137 S 11/2018 Ma
10,292,466 B2 5/2019 Ma
10,631,603 B2 4/2020 Ma
10,631,604 B2 4/2020 Ma

(56) References Cited

U.S. PATENT DOCUMENTS

| | | | |
|---|---|---|---|
| 10,631,605 | B2 | 4/2020 | Ma |
| 10,736,390 | B2 | 8/2020 | Ma |
| 10,874,182 | B2 | 12/2020 | Ma |
| 2001/0007260 | A1 | 7/2001 | Rousselle et al. |
| 2004/0025915 | A1 | 2/2004 | Wang |
| 2004/0123891 | A1 | 7/2004 | Ma |
| 2004/0255993 | A1 | 12/2004 | Ma |
| 2005/0115599 | A1 | 6/2005 | You |
| 2006/0005867 | A1 | 1/2006 | Chang |
| 2006/0024128 | A1 | 2/2006 | Chiu |
| 2006/0124160 | A1 | 6/2006 | Lee |
| 2007/0113878 | A1 | 5/2007 | Ko |
| 2007/0172310 | A1 | 7/2007 | Yang et al. |
| 2007/0261728 | A1 | 11/2007 | Lin et al. |
| 2009/0071518 | A1 | 3/2009 | Amsel |
| 2009/0126769 | A1 | 5/2009 | Hoogendoorn |
| 2009/0260664 | A1 | 10/2009 | Ma |
| 2010/0288318 | A1 | 11/2010 | Beaulieu |
| 2011/0017249 | A1 | 1/2011 | Ma |
| 2011/0132418 | A1 | 6/2011 | Ma |
| 2011/0209732 | A1 | 9/2011 | Ma |
| 2011/0214705 | A1 | 9/2011 | Ma |
| 2012/0318316 | A1 | 12/2012 | Choi et al. |
| 2013/0008478 | A1 | 1/2013 | Prieto |
| 2013/0206192 | A1 | 8/2013 | Ma et al. |
| 2013/0276843 | A1 | 10/2013 | Ma |
| 2014/0026931 | A1 | 1/2014 | Lee |
| 2014/0069476 | A1 | 3/2014 | Zimmer et al. |
| 2014/0246062 | A1 | 9/2014 | Ma |
| 2014/0251394 | A1 | 9/2014 | Ma |
| 2015/0237977 | A1 | 8/2015 | Ma |
| 2016/0115707 | A1 | 4/2016 | Schneider et al. |
| 2018/0110303 | A1 | 4/2018 | Ma |
| 2018/0153269 | A1 | 6/2018 | Ma |
| 2019/0373992 | A1 | 12/2019 | Ma |
| 2021/0030127 | A1 | 2/2021 | Ma |

FOREIGN PATENT DOCUMENTS

| | | |
|---|---|---|
| CN | 2776115 | 5/2006 |
| CN | 204444542 | 7/2015 |
| DE | 1152226 | 8/1963 |
| EP | 0202769 | 12/1989 |
| EP | 0897678 | 2/1999 |
| EP | 2 774 504 | 1/2017 |
| FR | 855628 | 5/1940 |
| FR | 002650491 | 2/1991 |
| FR | 2857835 | 1/2005 |
| GB | 2113543 | 8/1983 |
| GB | 2165448 | 11/1987 |
| JP | 61131921 | 8/1986 |
| JP | H08-322621 | 12/1996 |
| JP | 2002-336020 | 11/2002 |
| JP | 3144314 | 7/2008 |
| JP | 2009-045359 | 3/2009 |
| KR | 100851744 | 8/2008 |
| KR | 10-2009-0110808 | 10/2009 |
| KR | 10-2012-0107607 | 10/2012 |
| WO | WO 2005/023042 | 3/2005 |
| WO | WO 2017/048868 | 3/2017 |

OTHER PUBLICATIONS

Extended European Search Report issued in EP Application No. 14157685, dated Jul. 7, 2014, in 8 pages.

Extended European Search Report issued in EP Application No. 14158057, dated Jul. 7, 2014, in 7 pages.

Extended European Search Report issued in EP Application No. 15156587.6, dated Jul. 23, 2015, in 7 pages.

International Search Report and Written Opinion issued in PCT Application No. PCT/US2016/051771, dated Dec. 28, 2016.

Treasure Garden, 2010 Products Catalog, pp. 20 and 60.

* cited by examiner

QUICK ASSEMBLY METHODS AND COMPONENTS FOR SHADE STRUCTURES

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57.

BACKGROUND OF THE INVENTION

Field of the Invention

This application relates to apparatuses and methods that facilitate efficient assembly of ribs and hubs of umbrellas and other structures with a plurality of elongate structural members that extend from a central portion of the hub.

Description of the Related Art

Large umbrellas, such as market umbrellas, generally include a frame that is used to support and distribute the weight of an upper portion of the umbrella as well as to enable the umbrella to be opened and closed as desired by the user. The frame of such umbrellas can take various forms, but often includes one or more hubs connected with a plurality of movable structural members, sometimes called ribs and/or struts.

Prior art methods of assembly of umbrella hubs and ribs are too labor intensive. The process involves inserting a pin through an end portion of each rib of a set of ribs, positioning all of the rib ends in a lower portion of a hub, and then placing an upper portion of the hub over the rib ends so positioned. Finally, screws are advanced through upper and lower hub portions to attach the upper portion to the lower portion of the hub. While achieving the result of a secure assembly of hub and ribs, this process is tedious and sometimes requires rework, for example if the ends of any of the ribs become misaligned before the upper hub portion is attached to the lower hub portion.

SUMMARY OF THE INVENTION

It would be beneficial to provide structures that enable quicker and less labor intensive assembly of umbrella assemblies, e.g., rib and hub assemblies. An aspect of at least one of the embodiments disclosed herein is the realization that connection devices used in the assembly of shade structures, such as pavilions and outdoor umbrellas, can be improved to provide a more secure, quicker, and more reliable connection. Such devices can be advantageously configured with fewer parts, making them easier to manufacture than devices in the prior art. Such improved connection devices can be particularly advantageous for large shade structures.

Another aspect of at least one of the embodiments disclosed herein is the realization that umbrella rib structures can be improved to provide a more resilient retention with less friction during operation by providing a pivot member with a larger transverse dimension than pivot members of prior art umbrella rib structures. Such devices can have a longer usage life and may improve user experience by reducing noise caused during operation of the umbrella assembly.

Yet another aspect of at least one of the embodiments disclosed herein is that umbrella rib structures can be improved by integrating a removable pulley structure to provide quicker assembly and removal than existing pulley structures. A removable pulley structure can include a slot accessible from the exterior of the umbrella rib structure that can be used to insert a pulley. A removable pulley can be retained inside a slot by using a trapping member that can trap the pulley in the slot and preventing the pulley from being removed during operation. A removable pulley can provide users the freedom to determine whether or not to install a pulley to aid in operation of the umbrella assembly. Removable pulley devices can be advantageously configured with fewer parts than, for example, integrated pulley devices, making them easier to manufacture than devices in the prior art.

In one embodiment, an umbrella assembly is provided that includes a hub and a rib. The hub has a passage configured to be disposed about an umbrella pole. The hub also has an upper portion and a lower portion. The upper portion includes a top surface that extends between the passage and an outer periphery of the hub. The lower portion includes a bottom surface that extends between the passage and the outer periphery of the hub. The hub also includes a rib engagement section comprising a groove that extends radially inwardly from the outer periphery and an annular bearing zone disposed on each side of the groove. The annular bearing zone may be disposed between two facing walls of the hub. The annular bearing zones have an outward surface and an inward surface. The inward surface is disposed on a protrusion that extends toward the groove. The protrusion has a major dimension and a minor dimension. The rib has an elongate body and a pivot member. The elongate body has a longitudinal axis that extends between an inner end and an outer end. An inner portion of the elongate body disposed adjacent to the inner end is disposed in the groove. The pivot member has a central portion that extends through the inner portion of the elongate body, a first free end, and a second free end. The first free end is disposed away from the central portion and has a first recess formed therein. The second free end is disposed opposite the first free end and away from the central portion. The second free end has a second recess formed therein. Each of the first recess and the second recess has an assembly access path on one side thereof. The assembly access pathway has a width that is greater than the minimum dimension and less than the major dimension.

In another embodiment, an umbrella hub is provided. The umbrella hub includes a passage configured to be disposed about an umbrella pole, an upper portion, and a lower portion. The upper portion includes a top surface that extends between the passage and an outer periphery of the hub. The lower portion includes a bottom surface that extends between the passage and the outer periphery of the hub. The hub includes a rib engagement section that has a groove that extends radially inwardly from the outer periphery and an annular bearing zone disposed on each side of the groove. The annular bearing zone has an outward surface and an inward surface. The inward surface disposed on a protrusion that extends toward the groove. The protrusion has a major dimension and a minor dimension. The annular bearing zone is configured to support an end portion of a pivot member of an umbrella rib.

In another embodiment, an umbrella assembly is provided that includes a hub and a rib. The hub has an outer periphery and a groove extending radially inwardly from the outer periphery. A protrusion with a support surface is disposed in the groove. The protrusion has a width less than a length. The rib has an elongate body and a pivot member. The elongate body has a longitudinal axis that extends between an inner end and an outer end. An inner portion of the elongate body disposed adjacent to the inner end thereof is disposed in the groove. The pivot member has a free end disposed away from the elongate body. The free end has a recess formed therein and an assembly access portion. The assembly access portion has a width greater than the width of the protrusion and less than the length of the protrusion.

In another embodiment, an umbrella hub is provided that includes a central portion, a body extending between the central portion and an outer periphery of the hub, and a capture member. The central portion is configured to be disposed about a longitudinal axis of an umbrella pole. The body has an engagement section adjacent to the outer periphery. The engagement section is configured to receive an end portion of an umbrella structural member. The capture member extends into the engagement section. The capture member is configured to accept a pivot member coupled with the end portion of the umbrella structural member at an insertion angle. The insertion angle can be at about 90 degrees to about 180 degrees, where the angle is measured between the longitudinal axis of the elongate member and the longitudinal axis of the umbrella hub. The insertion angle can be at about 100 degrees to about 160 degrees from the longitudinal axis of the elongate member to the longitudinal axis of the umbrella hub. The insertion angle can be at about 110 degrees to about 150 degrees from the longitudinal axis of the elongate member to the longitudinal axis of the umbrella hub. The insertion angle can be at about 120 degrees to about 140 degrees from the longitudinal axis of the elongate member to the longitudinal axis of the umbrella hub, including the foregoing values and ranges bordering therein.

In another embodiment, an umbrella hub is provided that includes a central portion configured to receive an umbrella pole. The umbrella hub also includes a body that extends between the central portion and an outer periphery of the hub. The body has an engagement section adjacent to the outer periphery. The engagement section is configured to receive an end portion of an umbrella structural member. A retention structure is disposed within the engagement section. The retention structure has an elongate channel comprising a first portion comprising an access path and a second portion comprising at least one capture member that extends into the elongate channel. The capture member has a protruding surface. The protruding surface is configured to slidably accept the end portion of the umbrella structural member, such that the structural member can be directed through the first portion of the elongate channel toward the second portion thereof. In a first position, the umbrella structural member can be inserted or removed from the retention member. The umbrella structural member can be placed in a second position by rotating the umbrella structural member relative to the retention structure. In the second position, the protruding surface rotatably secures the structural member.

BRIEF DESCRIPTION OF THE DRAWINGS

The abovementioned and other features of the inventions disclosed herein are described below with reference to the drawings of the preferred embodiments. The embodiments are intended to illustrate, but not to limit the inventions. The drawings include the following figures.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of this application provided that the features included in such a combination are not mutually inconsistent.

In accordance with embodiments described herein, there are provided various configurations of a hub and hub assembly that can be used with an umbrella support structure, such as an umbrella frame or pavilion frame, to facilitate the rapid and secure fastening of structural ribs with a hub or other structure. As described in greater detail herein, the hub and hub assembly can incorporate various features such that a secure connection between an umbrella rib and a hub of an umbrella frame can be obtained. Additional details and features of related umbrella rib connectors and assemblies are illustrated and described in Applicant's U.S. Pat. No. 7,703,464, issued Apr. 27, 2010, entitled Quick Connector for Shade Structure, the entirety of the contents of which is incorporated herein by reference.

Figure 1:
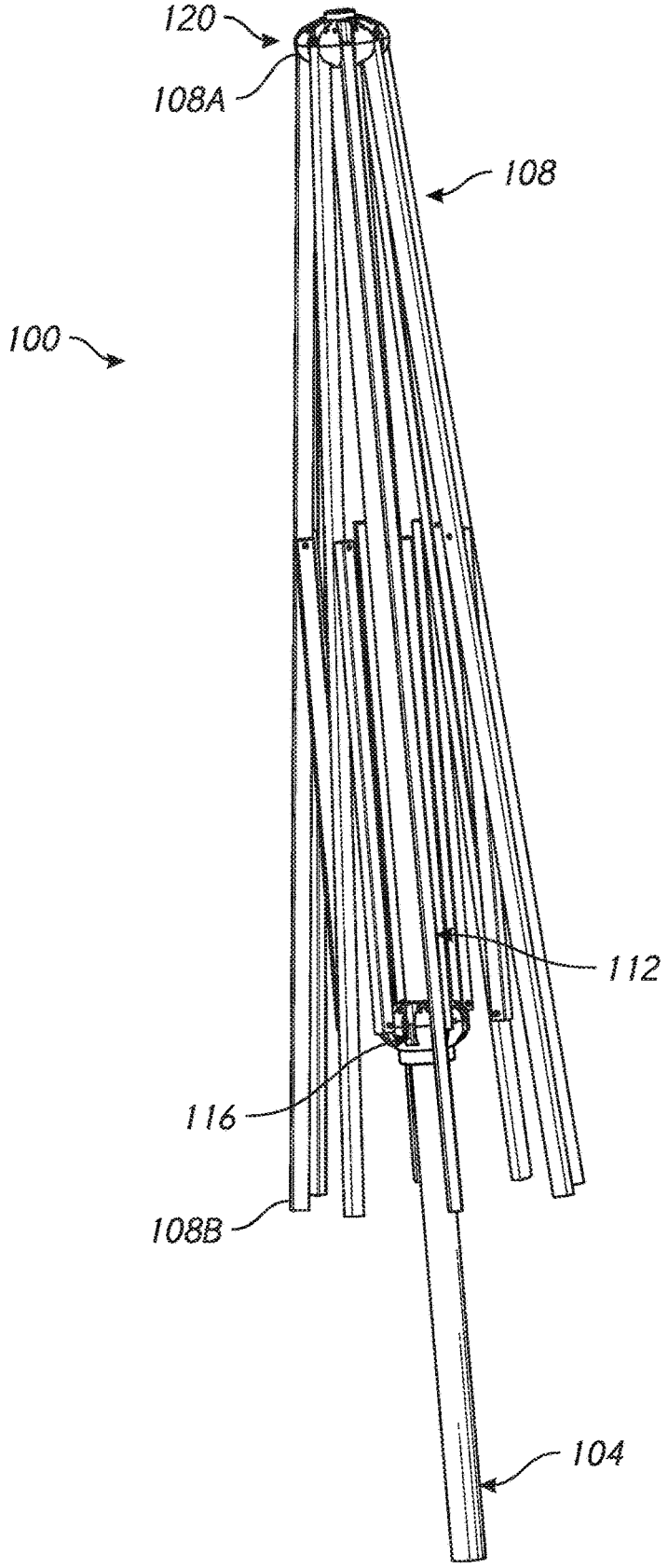
FIG. 1 is a side elevation view of an umbrella assembly including upper and lower hubs disposed about an umbrella pole and a plurality of umbrella ribs and struts extending therefrom, according to one embodiment.

FIG. 1 shows an umbrella assembly 100 that includes umbrella hub assemblies 116, 120. The umbrella hub assemblies 116, 120 are configured for excellent manufacturability and also for efficient use of components, such as reducing the number of components. The umbrella assembly 100 includes a lower hub 116. The umbrella assembly 100 also includes an upper hub 120. Although the description herein is primarily directed to the umbrella hub assembly 120 it is to be understood that features of the umbrella hub assembly 120 can also be used or provided with the lower hub 116 (as discussed below) or with intermediate hubs (not shown) disposed between an upper hub and a lower hub.

FIG. 1 also shows that that the umbrella assembly 100 can include a plurality of structural members, e.g., including ribs 108 and struts 112. Each of the ribs 108 has an inner end 108A, an outer end 108B, and a body extending along a longitudinal axis therebetween. The inner end 108A has a transverse pivot member 440, which can be a rib retention member 728, (see FIGS. 9A to 9E) that extends away from the longitudinal axis. Details of the inner end 108A and the pivot member 440 are shown throughout, for example in FIGS. 5, 8A-8C, and 9A-9E and are discussed further below.

Figure 2:
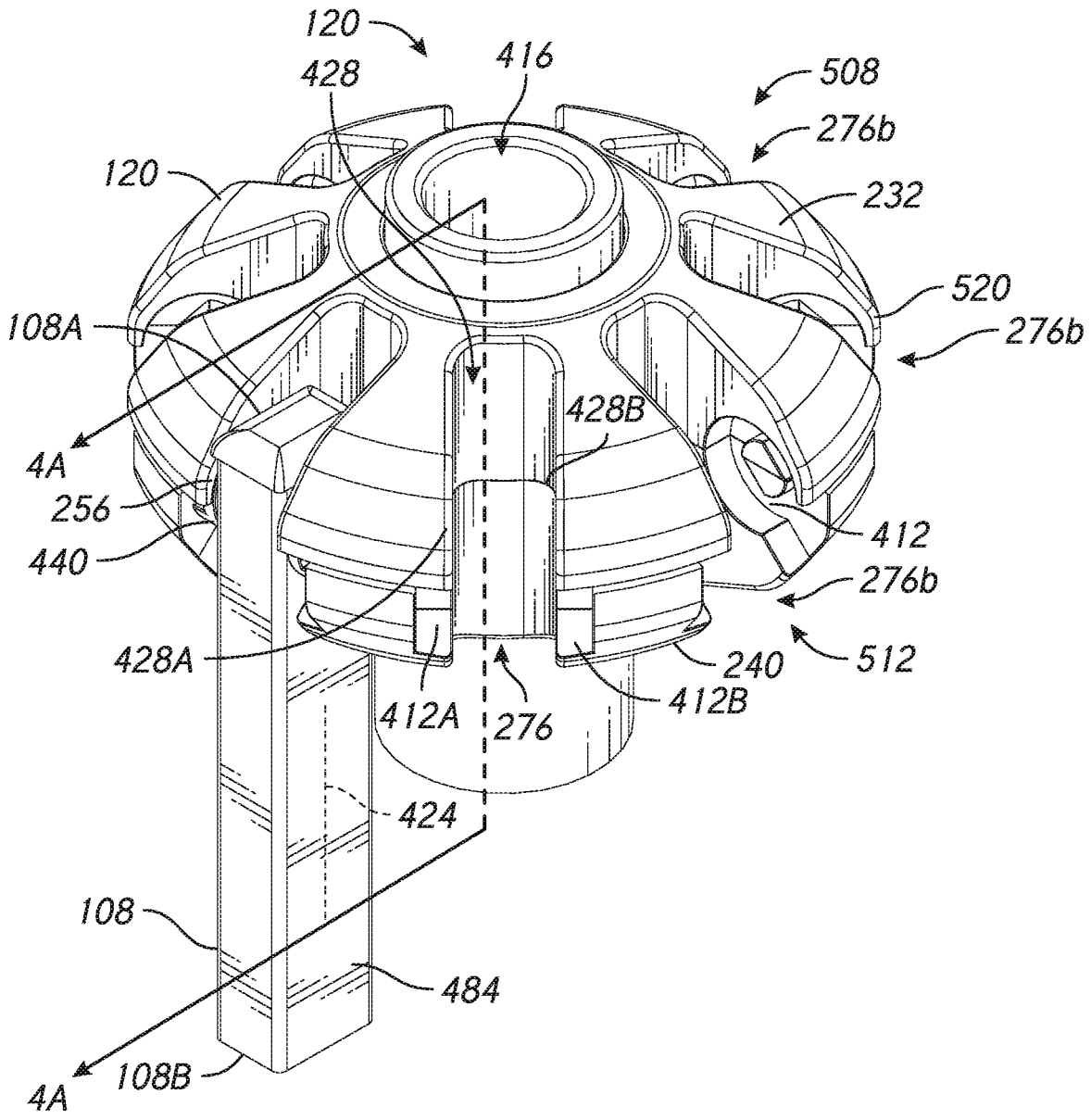
FIG. 2 is a top perspective view of an assembly including a hub and a rib.
Figure 3:
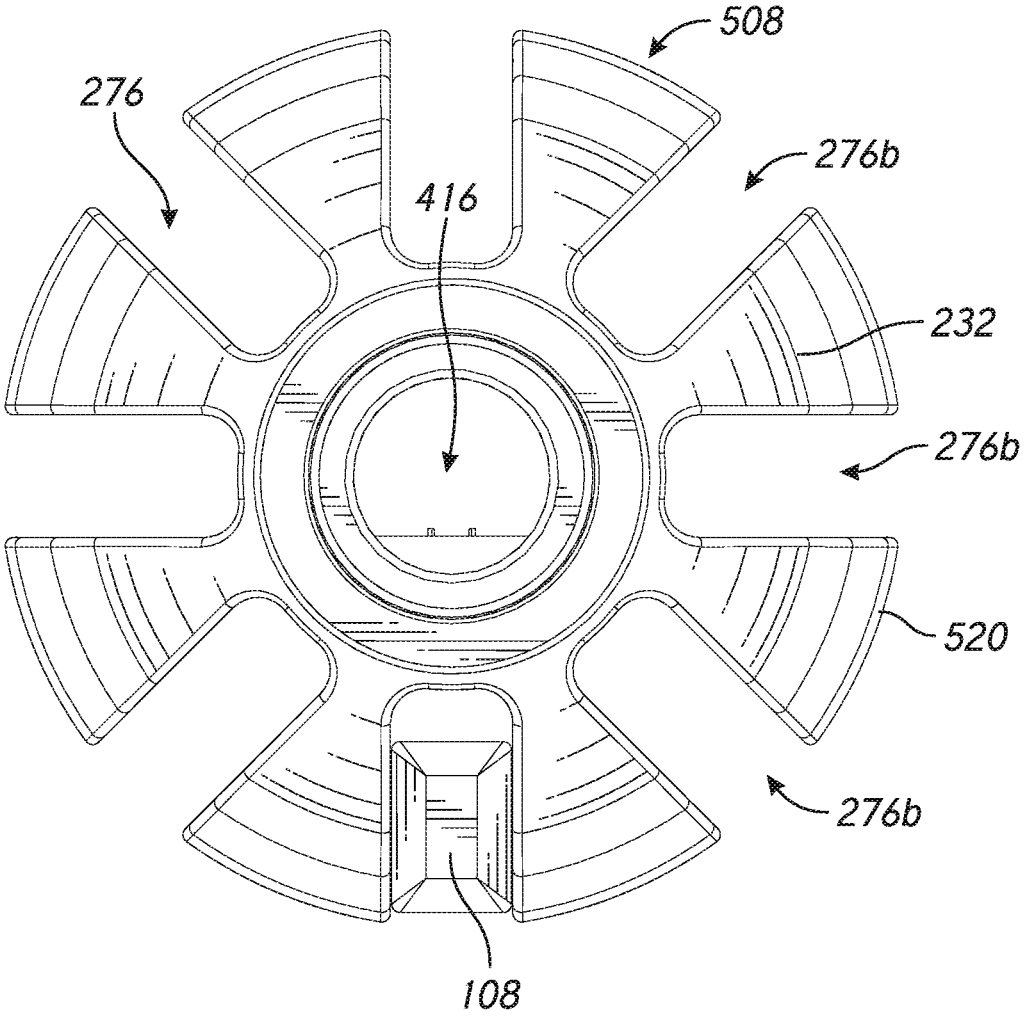
FIG. 3 is a top view of an upper portion of a hub of the assembly of FIG. 2.
Figure 4B:
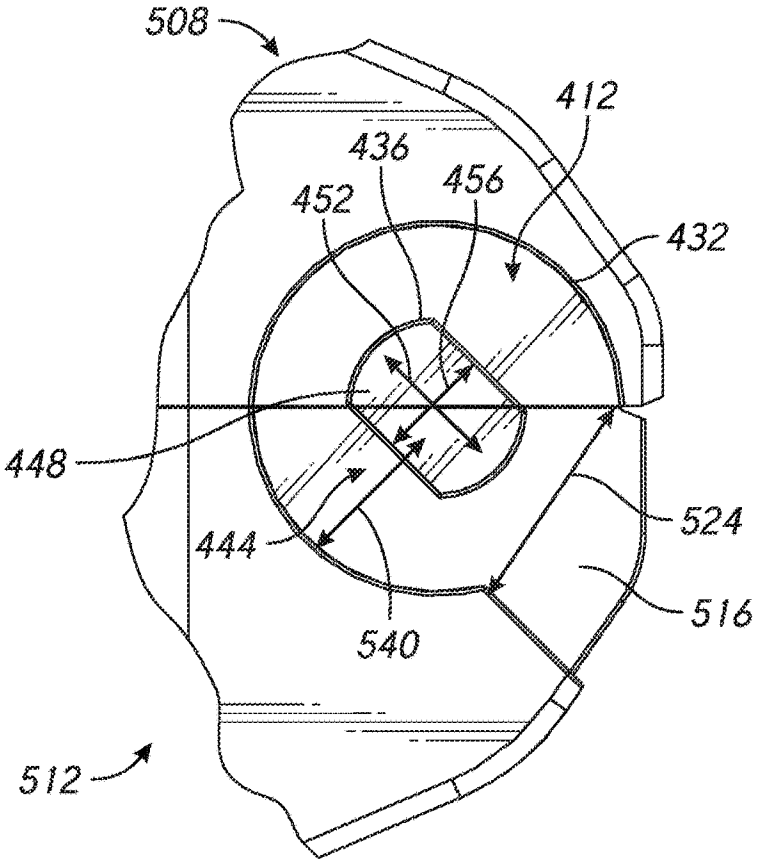
FIG. 4B is a detail view of an annular bearing zone of one embodiment of the hub of FIG. 2.
Figure 4A:
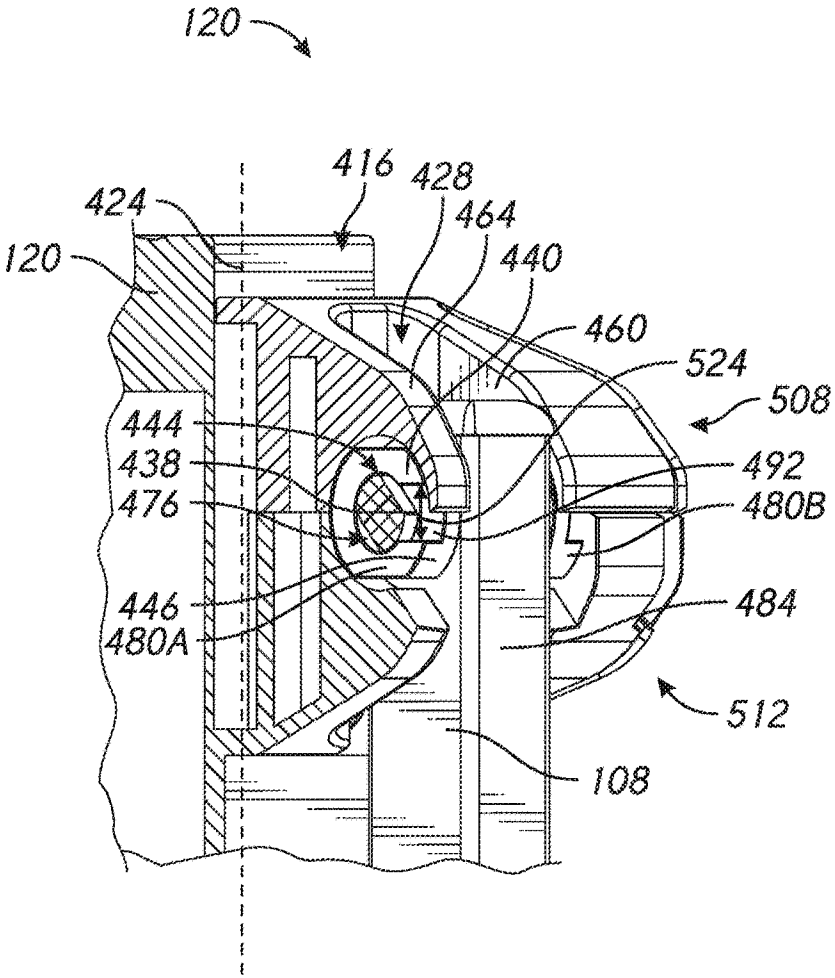
FIG. 4A is an enlarged perspective cross-section view of an assembly including the hub and the rib of FIG. 2 taken through section plane 4A-4A shown in FIG. 2.

FIG. 4A-4B show that the pivot member 440 can be disposed in an annular bearing zone 412 of the umbrella hub 120. FIG. 2 also shows that the umbrella rib 108 is attached to the hub 120. The pivot member 440 enables the rib 108 to pivot relative to the hub 120. The hub 120 can further comprise an upper portion 508 and a lower portion 512. The upper and lower portions 508, 512 are disposed about a passage 416. The upper and lower portions 508, 512 can extend generally symmetrically outward from the passage 416. The passage 416 can be configured to be disposed about an umbrella pole 104. The upper portion 508 can include a top surface 232 that extends between the passage 416 and an outer periphery 520 of the hub 120. The lower portion 512 can include a bottom surface 240 that extends between the passage 416 and the outer periphery 520 of the hub 120.

Figure 8C:
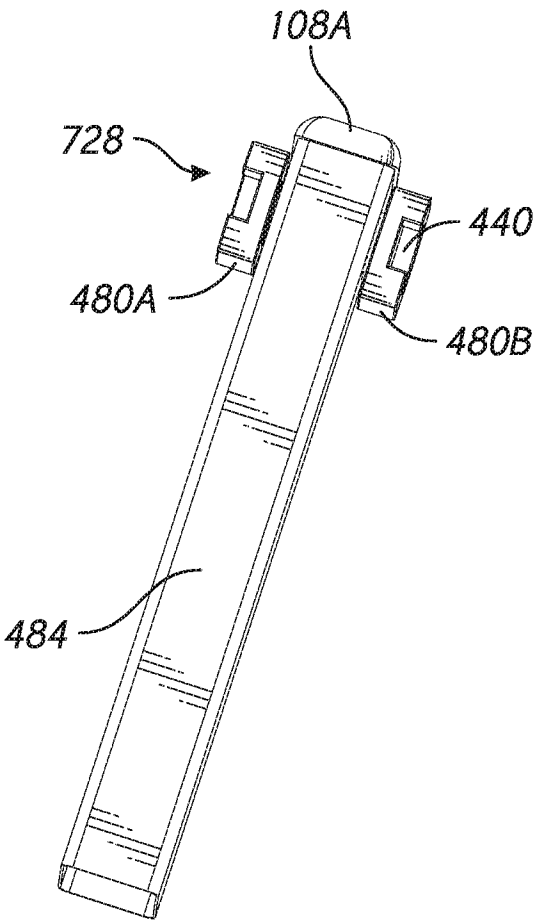
FIGS. 8A-8C show one embodiment of an inner end of components of the rib of FIG. 2 in three assembly states.
Figure 8B:
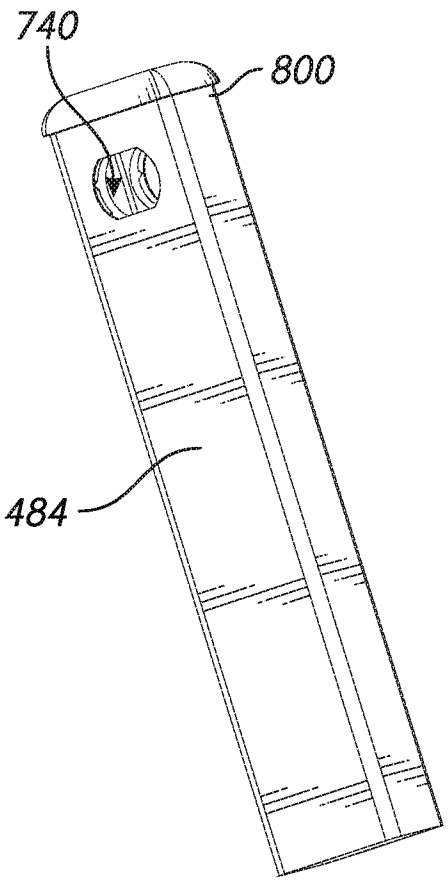
Figure 8A:
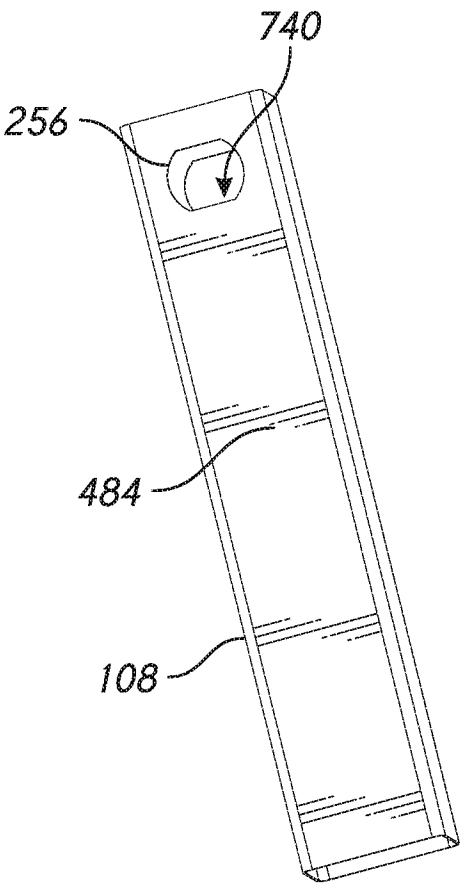

The rib 108 has an elongate body 484 that can be coupled with the pivot member 440. The elongate body 484 can have a longitudinal axis 424 that extends between an inner end 108A and an outer end 108B. An inner portion 256 of the elongate body 484 disposed adjacent to the inner end 108A can be disposed in a groove 428 of the hub 120. The inner portion 256 can comprise an aperture 740, as shown in FIGS. 8A-8B. The hub 120 can include a rib engagement section 276. There may be a plurality of rib engagements sections 276*b* disposed symmetrically about the hub 120. The rib engagement section 276 can comprise a groove 428 that extends radially inwardly from the outer periphery 520 and an annular bearing zone 412. In the illustrated embodiment, a first annular bearing zone 412A is disposed on a first side 428A of the groove 428 and a second annular bearing zone 412B is disposed on a second side 428B of the groove 428.

FIG. 4A shows free ends 480A, 480B of the pivot member 440 pivotably attached to the hub 120. FIG. 4B shows the structure of the annular bearing zone 412 according to one embodiment. An annular bearing zone 412 can be disposed on each side of the groove 428. In some embodiments, the annular bearing zone 412 can be disposed on either side of the groove 428. The annular bearing zone 412 can have an outward surface 432 and an inward surface 436. The annular bearing zone 412 can be configured to support the pivot member 440 of the umbrella rib 108. The annular bearing zone 412 can comprise a protrusion 444. The protrusion 444 can comprise a support surface 448 disposed in the groove 428. The inward surface 436 can be disposed on the protrusion 444 that extends toward the groove 428. The protrusion 444 can have a major dimension 452 and a minor dimension 456. In some embodiments, a protrusion 444 can be disposed on each of the two opposing sides of the groove 428, and the pivot member 440 can comprise first and second free ends 480A, 480B. Each of the two free ends 480A, 480B can comprise a recess 476 configured to receive a corresponding protrusion 444 of the annular bearing zone 412.

The free ends 480A, 480B can be disposed away from the elongate body 484 of the rib 108. The free ends 480A. 480B can also include an assembly access portion 492. The assembly access portion 492 can comprise a width 524 less than the major dimension 452 and greater than the minor dimension 456 of the protrusion 444.

Figure 5:
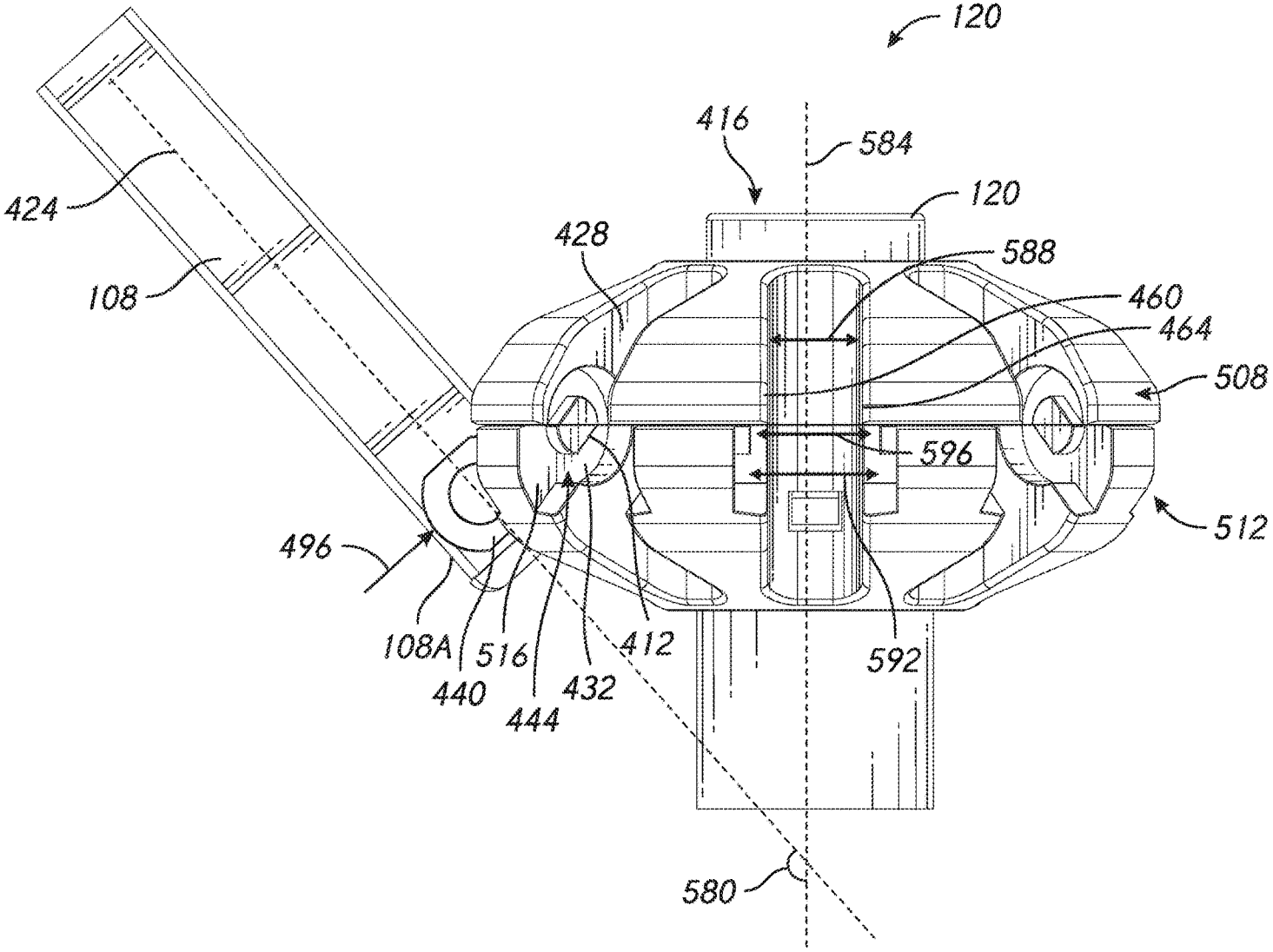
FIG. 5 is a plan view of an assembly step involving the hub and the rib of FIG. 2, the rib being assembled with the hub at a non-operational orientation of the rib.
Figure 9C:
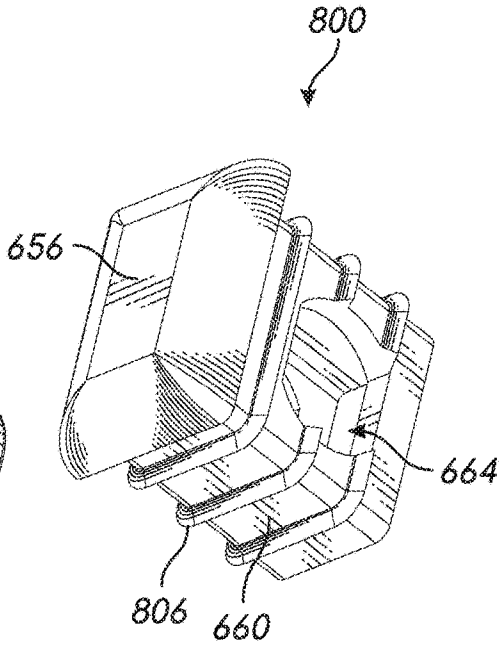
FIGS. 9A-9E show components of a rib retention member of the umbrella hub and rib assembly of FIG. 2.
Figure 9B:
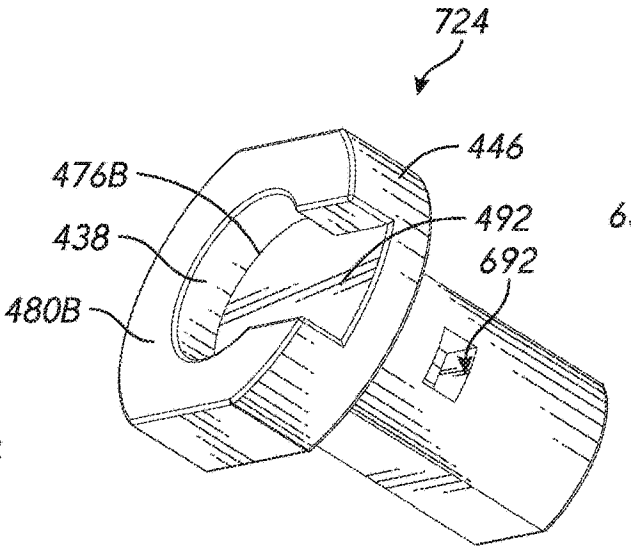
Figure 9A:
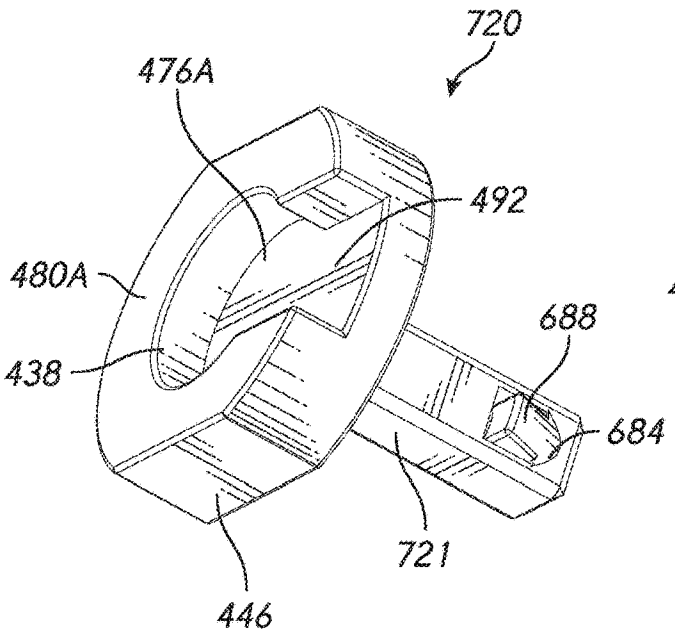
Figure 10:
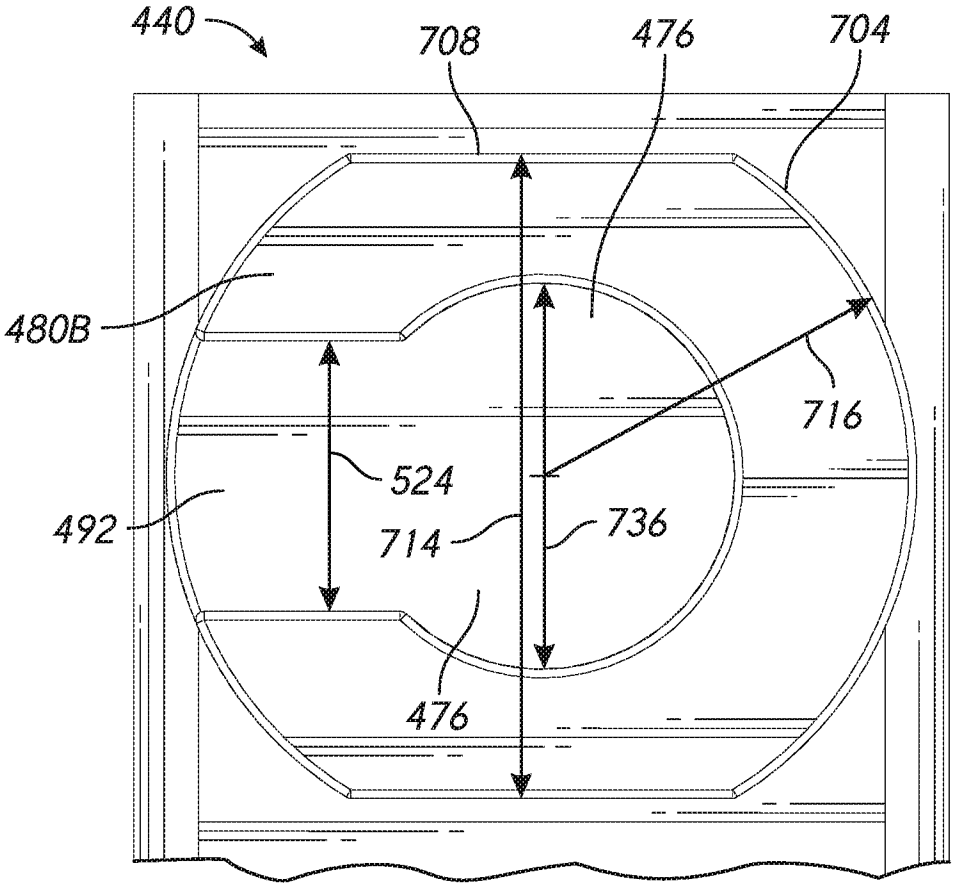
FIG. 10 shows a side view of a rib retention member of the umbrella hub and rib assembly of FIG. 2.

As shown in FIG. 5, the hub 120 and the pivot member 440 can be configured such that the access portion 492 shown in FIGS. 4A, 9A, and 10 faces the protrusion 444 when the pivot member is being inserted into the hub 120 at a direction of insertion 496. The direction of insertion 496 can comprise a direction along an axis along which the rib member 108 can be assembled to the hub 120. The rib member 108 can be configured to be at a non-operational orientation during insertion. FIG. 4B shows that the hub 120 can include an access path 516. The access path 516 is a path along which the retention member 728 of the rib 108 is moved in connecting the rib 108 to the hub 120. The access path 516 can face away and generally opposite from the direction of insertion 496. The orientation of the access path 516 can correspond to a non-operational orientation that is provided for assembly of these components. A non-operational orientation for assembly can be provided when the assembly access portion 492 is aligned with the access path 516.

The pivot member 440 can be disposed in the annular bearing zone 412 with an inward surface 438 of the pivot member 440 facing, adjacent to, and/or engaging the inward surface 436 of the annular bearing zone 412 and an outward surface 446 of the pivot member 440 facing, adjacent to, and/or engaging an outward surface 432 of the annular bearing zone 412. This configuration provides two sets of annular interfaces between the pivot member 440 and the hub 120 which provides for smooth pivoting of the rib 108 in the hub 120.

Pulley Mounting Zone

Figure 6B:
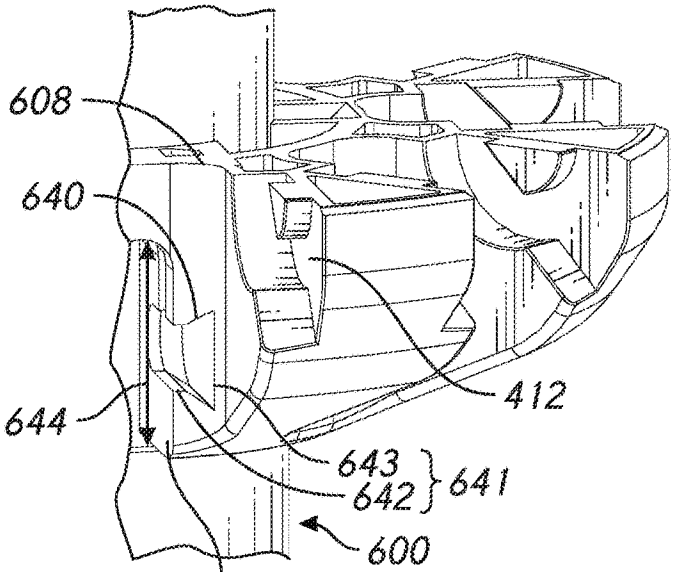
FIGS. 6A-6B show a lower portion of an umbrella hub of the assembly of FIG. 2 illustrating a pulley retention zone.
Figure 6C:
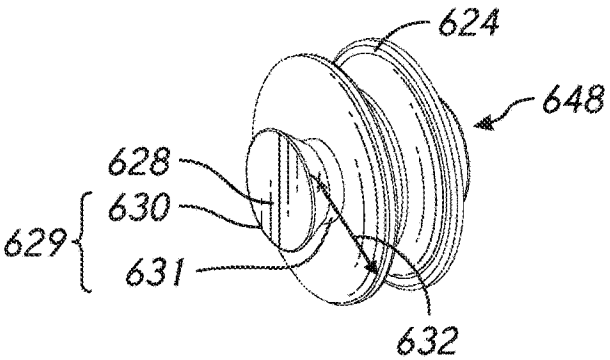
FIG. 6C is a perspective view of a pulley device used with the assembly of FIG. 2.
Figure 6A:
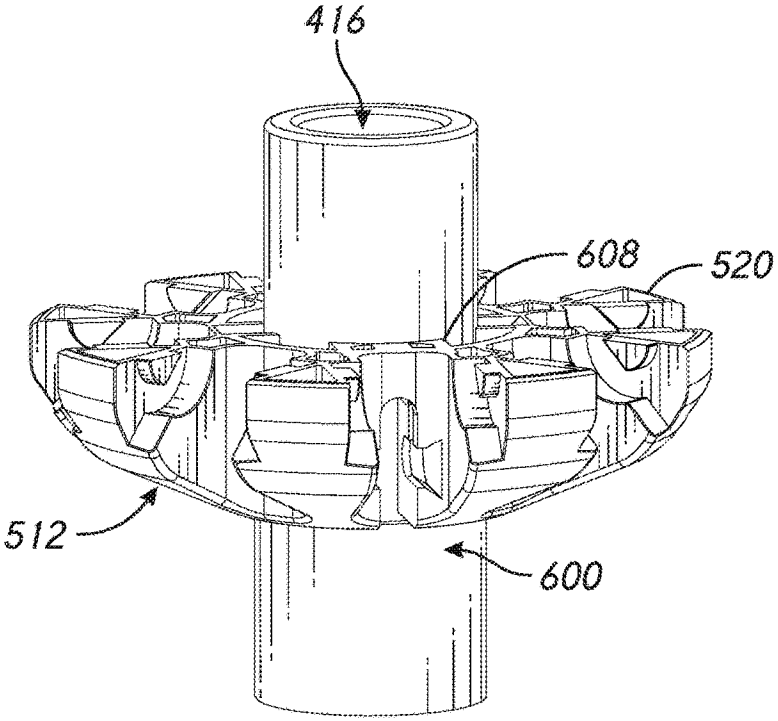
Figure 7B:
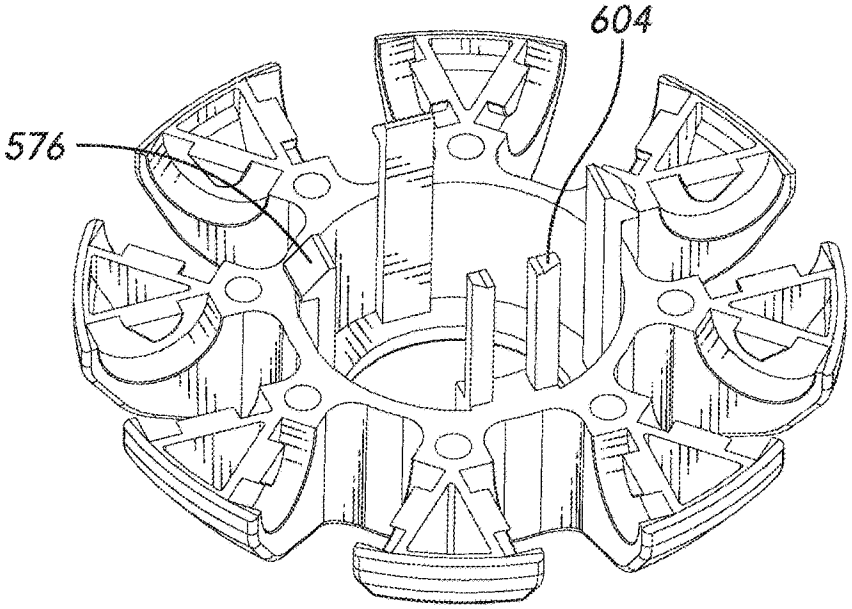
FIGS. 7A-7B are top and bottom perspective views of an upper portion of an umbrella hub of the assembly of FIG. 2 showing locking members and trapping members thereof.
Figure 7A:
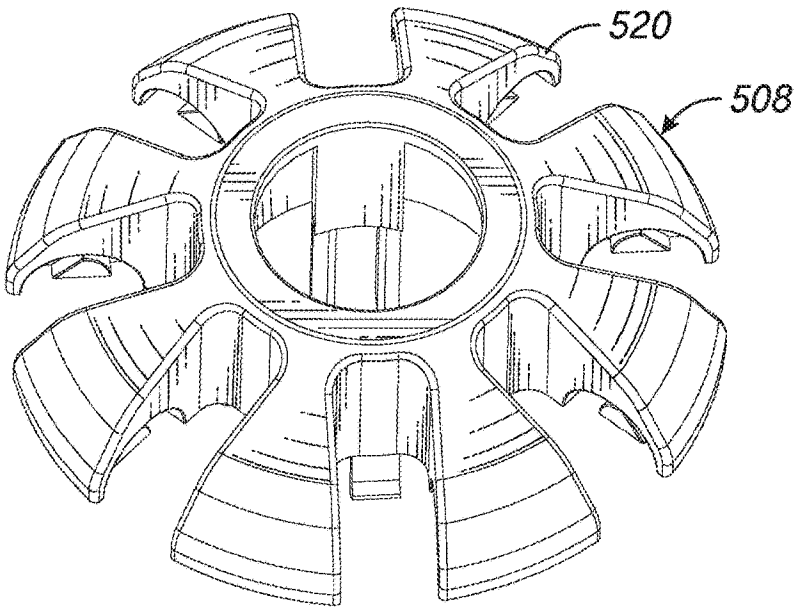

FIGS. 6A-6B show that the umbrella hub 120 can comprise a pulley mounting zone 600. The pulley mounting zone 600 can be disposed in the lower portion 512 of the hub 120. The pulley mounting zone 600 can be accessible from the outer periphery 520 when the upper portion 508 is separated from the lower portion 512. As shown in FIG. 7, the upper portion 508 can comprise a trapping member 604 projecting away from a lower surface of the upper portion 508. When assembled such that the upper portion 508 is coupled with the lower portion the trapping member 604 projects into the lower portion 512. A pulley 648 shown in FIG. 6C can be disposed in the pulley mounting zone 600. In some embodiments, the pulley mounting zone 600 can be disposed in the upper portion 508 of the hub 120, while the trapping member 604 can project from the lower portion 512 toward the upper portion 508.

The trapping member 604 of the upper portion 508 can be advanceable into a trapping position. In the trapping position, the pulley 648 disposed in the pulley mounting zone 600 can be prevented from coming out of the pulley mounting zone 600. The trapping member 604 can be in the trapping position when the upper portion 508 is assembled to the lower portion 512. The lower portion 512 can comprise a trapping slot 608 and in some cases a plurality of, e.g., two, slots configured to accept and align the trapping member 604. The trapping member 604 can comprise a plurality of, e.g., two projections. In some embodiments, the trapping slot 608 can be disposed in the upper portion 508 instead of the lower portion 512. In an assembled state, the two protections can extend across a horizontal plane extending between the pulley 648 and the outer periphery 520, the two projections disposed between the pulley 648 and the outer periphery 520 of the hub 120. Thus, the trapping members 604 prevent the pulley from being dislodged laterally or radially out of the hub 120 when the upper and lower hub portions 508, 512 are assembled.

FIG. 6C shows the pulley 648 comprising a wheel member 624 and a bearing member 628. The wheel member 624 can comprise a radius and the bearing member 628 can be disposed on or near the center of the wheel member 624. The bearing member 628 of the pulley 648 can comprise a tapered structure 629. The tapered structure 629 can be used to align the wheel member 624 with the pulley mounting zone 600 and facilitate the rotation of the pulley 648 during operation. The tapered structure 629 can comprise an inner end 631 and an outer end 630, the inner end connected to the center of the wheel member 624 and the outer end 630 disposed away from the center of the wheel member 624. The outer end 630 of the tapered structure 629 can comprise a diameter grater than diameter of the inner end 631.

The pulley mounting zone 600 can comprise a wheel slot structure 636 and a bearing slot structure 640. The wheel slot structure 636 can be shaped and sized to accept the wheel member 624 of the pulley 648. The wheel slot structure 636 can comprise a wheel slot dimension 644 extending parallel to longitudinal axis of the passage 416. The bearing slot structure 640 can be shaped and sized to accept the bearing member 628 from the outer periphery 520 towards the passage 416 and can extend transversely from the wheel slot dimension 644. The dimension 644 of the wheel slot can be greater than two times the radius 632 of the wheel member 624. The two projections of the trapping member 604 can be configured to trap the bearing member 628 and not the wheel member 624.

Figure 6D:
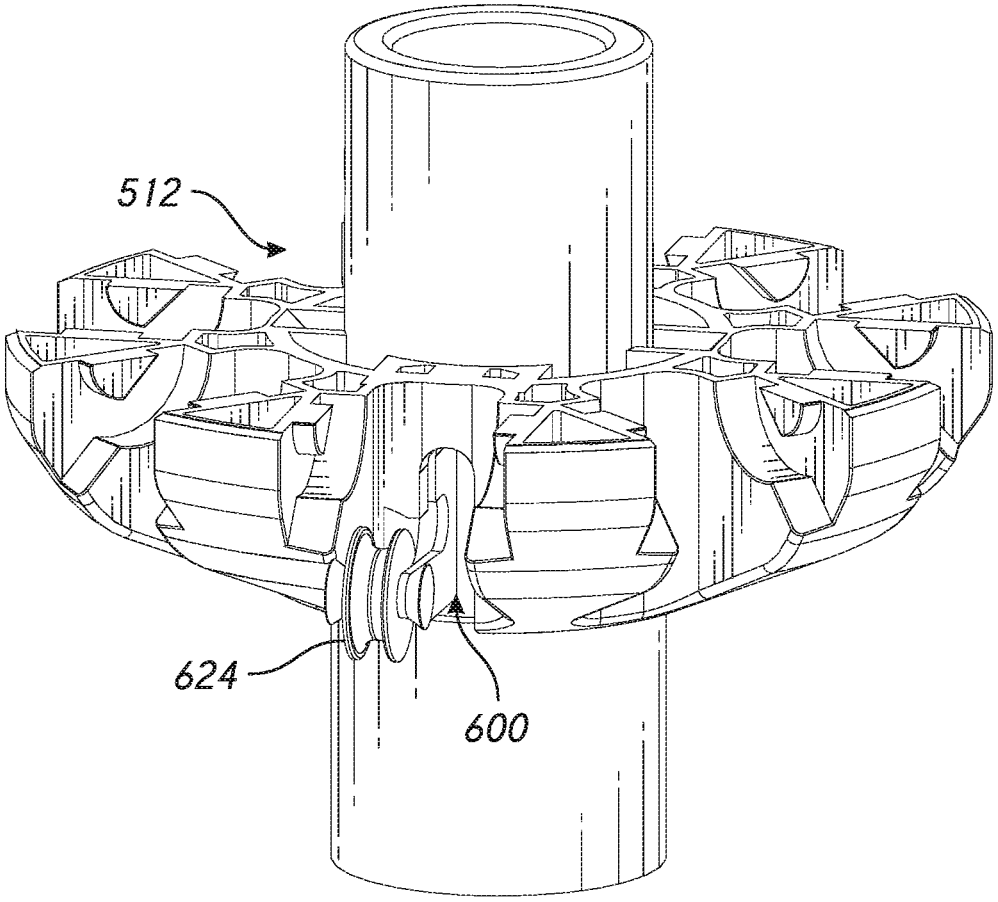
FIG. 6D is an exploded view of an assembly including the pulley device of FIG. 6C and the hub portion illustrated in FIGS. 6A-6B.

FIG. 6D shows the pulley 648 separated from the pulley mounting zone 600. The pulley 648 can be inserted into the pulley mounting zone 600 in one assembly method as described herein. The structure can be on the lower portion 512. So, the pulley 648 can be inserted on the lower portion 512. The bearing slot portion 640 can comprise a mating tapered structure 641. The mating tapered structure 641 can comprise an inner end 642 and an outer end 643. Each of the inner and outer ends 642, 643 of the mating tapered structure 641 can mate with the inner and outer ends 631, 630 of the tapered structure 629 of the pulley 648 during insertion of the pulley 648 to the pulley mounting zone 600, thereby aiding the alignment of the pulley 648 to the pulley mounting zone.

The upper portion 508 can be aligned with the lower portion 512 such that the trapping member 604 located between the outer periphery 520 and the passage 416 is aligned with the trapping slot 608. The trapping member 604 of the upper portion 508 can be inserted through the trapping slot 608 and into the pulley mounting structure 600. The trapping slot 608 can be disposed near the pulley mounting zone 600, e.g. directly above the bearing slot structure 640 as shown in FIG. 6B. Further coupling of the lower portion 512 of the hub 120 to the upper portion 508 moves the trapping member 604 to a trapping position, e.g., one where the trapping member 604 is disposed between the outer periphery 520 and the bearing member 628. Once in a trapping position, the trapping member 604 can prevent the pulley 648 from being inadvertently removed from the hub 120 during operation while permitting rotation of the pulley 648.

Rib Retention Member

FIG. 8A shows that the aperture 740 can be disposed on the inner portion 256 of the elongate body 484 of the rib 108. As shown in FIG. 8C, the inner portion 256 can comprise a retention member 728. The retention member 728 can comprise the pivot member 440 having free ends 480A, 480B and a central portion 800. The central portion 800 is shown without the pivot member 440 in FIG. 9C, and FIG. 8B and is shown coupled with the pivot member 440 without the elongate body 848 in FIG. 9F.

FIGS. 9A-9C show that the retention member 728 can comprise the central portion 800, a first lateral portion 720, and a second lateral portion 724. The central portion 800 can comprise a cap 656 and a projection 660 that is insertable into the elongate body 484. The projection 660 can further comprise retention structures 806 and a central portion aperture 664. The first free end 480A can be disposed away from the central portion 800 and can have a first recess 476A formed therein. The second free end 480B can be disposed opposite the first free end 480A and away from the central portion 800. The second free end 480B can have a second recess 476B formed therein.

Figure 9F:
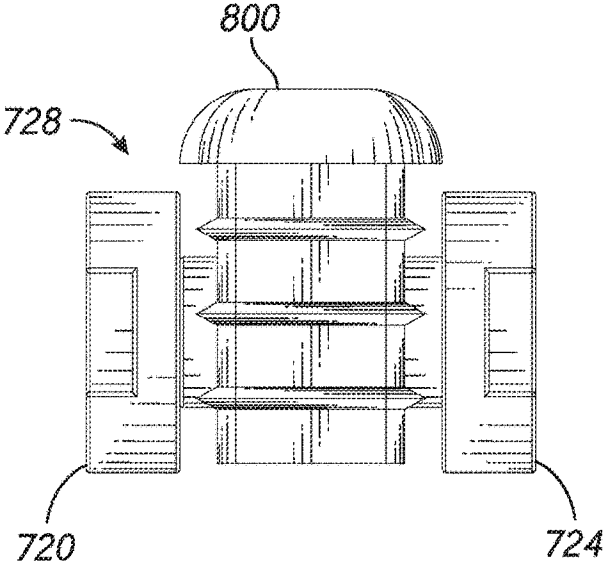
FIG. 9F shows the rib retention member of FIG. 2 in an assembled state with the rib removed to clarify the connection between a projection and a recess thereof.
Figure 9E:
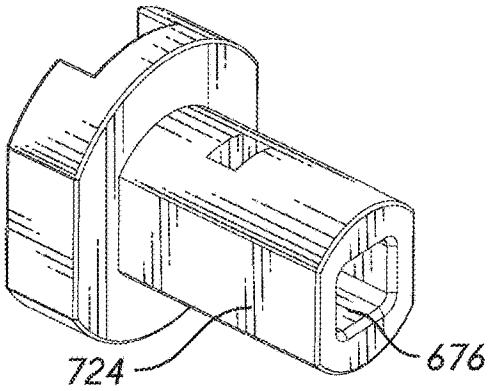
Figure 9D:
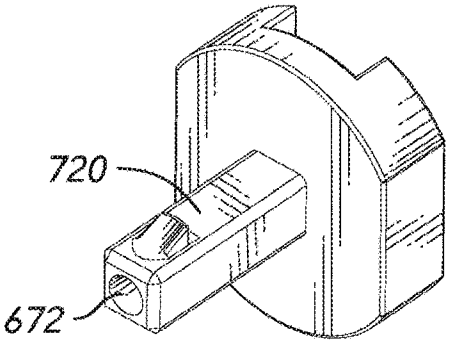

As shown in FIG. 9F, the first and second lateral portions 720, 724 can be advanced through or into the aperture 664 disposed on the central portion 800. The first and second lateral portions 720, 724 can be joined in the aperture 664. The first lateral portion 720 and the second lateral portion 724 can be joined through the apertures 664, 740 of the central portion and the elongate body 484. As shown in FIGS. 9D-9E, the first lateral portion 720 can comprise a projection 672. The second lateral portion 724 can comprise a recess 676. The recess 676 of the second lateral portion 724 can be configured to receive the projection 672.

The pivot member 440 can comprise a locking member 684 to secure the projection 672 in the recess 676. The locking member 684 can comprise a deflectable member 684. The locking member 684 can have a deflectable surface 688. The deflectable surface 688 can move to a low profile position during insertion of the projection 672 into the recess 676. The surface 688 of the locking member 684 can move to a high profile position when the projection 672 is fully inserted. When in the high profile position, the disengagement of the first lateral portion 720 from the second lateral portion 724 can be prevented.

The deflectable locking member 684 can comprise a resiliently mounted structure. That is the locking member 684 can be deflected and can return to a free state (e.g., an undeflected state) when not deflected. The locking member 684 can be disposed on the projection 721 of the first lateral portion 720. The second lateral portion 724 can comprise an aperture 692 sized to permit the deflectable locking member 684 to move such that the surface 688 is in the high profile position. The deflectable locking member 684 can be at least partially received in the aperture 692 with the surface 688 abutting an edge of the aperture 692.

FIG. 10 shows a side view of the free end 480B of the pivot member 440. The pivot member 440 can comprise an outer periphery. The outer periphery of the pivot member can comprise a circular portion 704 disposed at opposite ends thereof and a non-circular portion 708 disposed between the circular portions 704. The non-circular portion 708 can be separated from each other by a distance 714 less than two times the radius 716 of the circular portion 704.

The recess 476 can comprise a diameter 736. The diameter 736 can be greater than the width 524 of the assembly access portion 492.

Method of Assembly

As shown in FIG. 5, the rib 108 can be coupled with the hub 120 at a non-operational angle relative to the hub 120. The non-operational orientation can comprise an angle 580 or a range of angles disposed between the longitudinal axis 424 of the rib 108 and the longitudinal axis 584 of the passage 416. For example, the non-operational orientation of the rib 108 connected to the hub 120 can comprise angles 580 of the rib axis 424 relative to the passage axis 584 of between about 90 degrees to about 180 degrees from the longitudinal axis of the passage 584, in the direction of the upper hub 508. In some embodiments, the angle 580 in the non-operational orientation can be between about 110 degrees to about 170 degrees, including the foregoing values and ranges bordering therein. In some embodiments, the non-operational orientation can be one in which the outer end 108B of the rib 108 is disposed at an elevation above a horizontal plane intersecting the hub 120.

The rib 108 can be positioned adjacent to a groove 428 of the hub 120. A relative movement can be provided between the rib 108 and the hub 120 in a direction of insertion as indicated by the arrow 496, e.g., upward and laterally toward the passage 416 such that the pivot member 440 is disposed in the groove 428. In the case of the lower hub 116, the movement would be in a direction of insertion, e.g., downward and laterally toward a passage corresponding to the passage 416. The pivot member 440 can mate with one or more structures on or in the groove, such as the protrusion(s) 444. The direction of insertion 496 can be at an angle from the longitudinal axis 424 of the rib 108. The rib 108 can be pivotably coupled with the hub 120, for example, by rotating the rib 108 beyond the non-operational angle 580, e.g., into any angle in an operational range.

The rib 108 can be decoupled from the hub 120 at a non-operational orientation. A user can rotate the rib 108 such that the longitudinal axis of the rib 424 is at an angle 580 from the longitudinal axis 584 of the rib 108. The rib 108 can be decoupled from the hub 120 by moving the rib 108 at a direction opposite the direction of insertion 496. Because the rib 108 will not be at the non-operational configuration during use there is no risk of the rib inadvertently being disconnected. Also, the rib 108 is joined to the hub 120 when the hub is fully assembled without requiring fasteners to be used to secure the connection of components of the hub after the ribs are coupled to the hub.

As shown in FIG. 5, the groove 428 can comprise a width 588 between two opposing walls 460, 464. The assembly access path 516 formed on the two opposing walls 460, 464 can comprise a distance 592 between assembly access paths 516 greater than the distance 588 between the two opposing walls 460, 464. The protrusions 444 on the two opposing walls 460, 464 can comprise a distance between protrusions 596, the distance between protrusions 596 being greater than the groove wall distance 588 but less than the distance between the access paths 592. The access path 516 can be disposed on the lower portion 512.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A rib for coupling with a shade structure hub comprising:

an elongate body having a longitudinal axis extending between an inner end and an outer end, the elongate body having a side aperture spaced from the inner end and the outer end; and a pivot comprising:

a first member having a first free end and a first lateral portion; and a second member having a second free end and a second lateral portion;

wherein the first lateral portion and the second lateral portion are configured to couple to each other along an axis transverse to the longitudinal axis and through the side aperture in the elongate body;

wherein the pivot further comprises a central member including an inner projection configured to be received within the inner end of the elongate member, the inner projection including an inner aperture, the first and second lateral portions configured to be disposed within the inner aperture when assembled with the inner end.

2. A rib for coupling with a shade structure hub comprising:

an elongate body having a longitudinal axis extending between an inner end and an outer end; and a pivot member comprising:

a first member having a first free end and a first lateral portion; and a second member having a second free end and a second lateral portion;

wherein the first lateral portion and the second lateral portion are configured to couple through an aperture in the elongate body;

wherein the first lateral portion comprises a projection and the second lateral portion comprises a recess, the projection configured to be received within the recess.

3. The rib of claim 2, wherein the pivot member comprises a locking member, the locking member configured to secure the projection within the recess.

4. The rib of claim 3, wherein the locking member comprises a deflectable member having a blocking surface configured to move to a low profile position during insertion of the projection into the recess and configured to move to a high profile position when the projection is fully inserted, the high profile position preventing disengagement of the first lateral portion from the second lateral portion.

5. The rib of claim 4, wherein the deflectable member comprises a resiliently mounted wedge disposed on the projection of the first lateral portion, the resiliently mounted wedge comprising the blocking surface, the second lateral portion comprising an aperture sized to permit the resiliently mounted wedge to move such that the blocking surface is moved to the high profile position, the resiliently mounted wedge configured to be at least partially received in the aperture with the blocking surface abutting an edge of the aperture.

6. A rib for coupling with a shade structure hub comprising:

an elongate body having a longitudinal axis extending between an inner end and an outer end, the elongate body having a side aperture spaced from the inner end and the outer end; and a pivot comprising:

a first member having a first free end and a first lateral portion; and a second member having a second free end and a second lateral portion;

wherein the first lateral portion and the second lateral portion are configured to couple to each other along an axis transverse to the longitudinal axis and through the side aperture in the elongate body wherein the first free end includes a first outer periphery, and the first outer periphery includes a first circular portion disposed opposite a second circular portion and a first non-circular portion disposed opposite a second non-circular portion;

wherein the first free end includes a first recess, and the first recess includes a first central portion and a first assembly access path between the first central portion and the first outer periphery;

wherein the first free end is configured to be inserted within an annular bearing zone of the shade structure hub through a hub assembly access path and the first recess is configured to be disposed over a projection within the annular bearing zone of the shade structure hub through first assembly access path such that the elongate body is pivotable with the shade structure hub about the pivot.

7. The rib of claim 6, wherein the first assembly access path is configured to face the projection at a non-operational orientation when being assembled and faces away from a direction of insertion at operational orientations.

8. A rib assembly for coupling with a shade structure hub comprising:

an elongate body having an inner end and an outer end; and a pivot coupled with the inner end, the pivot comprising:

a first free end extending from a first side of the inner end;

a second free end extending from a second side of the inner end; and wherein the first free end includes an outer periphery and a recess, the outer periphery including:

a first circular portion having a first end and a second end;

a second circular portion disposed opposite the first circular portion;

a first non-circular portion connected at one end with the first end of the first circular portion; and a second non-circular portion disposed opposite the first non-circular portion and connected at one end with the second end of the first circular portion;

the recess including:

a first central portion: and a first assembly access path between the first central portion and the first outer periphery;

wherein the first circular portion and the second circular portion comprise circular arcs having a same radius measured from a common center point.

9. The rib assembly of claim 8, wherein the first assembly access path is aligned with the first and second non-circular portions of the outer periphery.

10. The rib assembly of claim 9, wherein a width of an opening of the first assembly access path is less than a diameter of the first central portion.

11. The rib assembly of claim 8, wherein a width between the first and second non-circular portions of the outer periphery is less than two times a radius of the first and second circular portions.

12. The rib assembly of claim 8, wherein the first free end is configured to be inserted within an annular bearing zone of the shade structure hub through a hub assembly access path and the first recess is configured to be disposed over a projection within the annular bearing zone of the shade structure hub through first assembly access path such that the elongate body is pivotable with the shade structure hub about the pivot.

13. The rib assembly of claim 12, wherein the first assembly access path is configured to face the projection at a non-operational orientation when being assembled and faces away from a direction of insertion at operational orientations.

14. The rib assembly of claim 8, wherein the pivot further comprises:

a first member including the first free end and a first lateral portion;

a second member including the second free end and a second lateral portion; and wherein the inner portion of the elongate member includes an aperture, the first lateral portion coupled with the second lateral portion through the aperture.

15. The rib assembly of claim 14, wherein the pivot further comprises a central member disposed within the inner end of the elongate member, the central member including an inner aperture, the first and second lateral portions disposed within the inner aperture.

16. The rib assembly of claim 14, wherein the first lateral portion comprises a projection and the second lateral portion comprises a recess configured to receive the projection of the first lateral portion.

17. The rib assembly of claim 16, wherein the pivot comprises a locking member to secure the projection in the recess.

18. The rib assembly of claim 8, wherein the first free end extends from a first side surface of the elongate body in a direction transverse to the longitudinal axis of the elongate body at a location between the inner end and the outer end;

the second free end extends from a second side surface in a direction opposite the transverse direction; and wherein the outer periphery is disposed away from the first side surface in the transverse direction.

19. The rib assembly of claim 8, wherein the second circular portion is connected at a first end with the first non-circular portion and at a second end with the second non-circular portion.

* * * * *